US006356066B1

(12) United States Patent
Iliasevitch

(10) Patent No.: US 6,356,066 B1
(45) Date of Patent: Mar. 12, 2002

(54) VOLTAGE REFERENCE SOURCE

(75) Inventor: Stepan Iliasevitch, Nepean (CA)

(73) Assignee: Nortel Networks Limited, St. Laurent (CA)

( * ) Notice: Subject to any disclaimer, the term of this patent is extended or adjusted under 35 U.S.C. 154(b) by 21 days.

(21) Appl. No.: 09/703,632

(22) Filed: Nov. 2, 2000

(30) Foreign Application Priority Data

Mar. 30, 2000 (CA) ..... 2303543

(51) Int. Cl.[7] ..... G05F 3/16; G05F 3/20
(52) U.S. Cl. ..... 323/317; 323/313
(58) Field of Search ..... 323/317, 313, 323/312

(56) References Cited

U.S. PATENT DOCUMENTS 4,639,661 A * 1/1987 Williams et al. ..... 323/317
4,775,829 A * 10/1988 Achstaetter ..... 323/313
5,049,806 A * 9/1991 Urakawa et al. ..... 323/314
5,057,709 A * 10/1991 Petty et al. ..... 327/277
5,721,484 A * 2/1998 Ngo et al. ..... 323/313
5,754,038 A * 5/1998 Durec et al. ..... 323/313
6,225,855 B1 * 5/2001 Taguchi ..... 327/538
6,232,756 B1 * 5/2001 Kurihara ..... 323/313

* cited by examiner

*Primary Examiner*—Bao Q. Vu

(57) ABSTRACT

The invention relates to a voltage reference source which is operable at a low voltage supply, e.g. 1.5V or lower, and allows for independent control of the magnitude and temperature dependence of the reference voltage. The source includes three transistors connected in parallel balanced with five resistors so as to provide the reference voltage in the form: $V_r=m_1V_{be}+m_2V_T+V_{be}$, wherein $V_r$ is the reference voltage, $V_{be}$ is a base-emitter voltage of a transistor, $V_T$ is a thermal voltage, and $m_1$ and $m_2$ are weight coefficients whose absolute and relative magnitudes can be varied. The sixth resistor is used for connection to a positive voltage. Corresponding method of forming the reference voltage is provided.

36 Claims, 1 Drawing Sheet

VOLTAGE REFERENCE SOURCE

FIELD OF INVENTION

The invention relates to a voltage reference source, and in particular, to the voltage reference source operable at a low voltage supply, for example of the order of 1.5V.

BACKGROUND OF THE INVENTION

For many microelectronics applications, it is extremely desirable to have a voltage reference circuit which would have a simple design and operate at a low voltage supply, for example of the order of 1.5V. Additionally, it would be desired for such a circuit to provide the required voltage temperature dependence and control it independently from the voltage magnitude. Unfortunately, the existing voltage reference circuits hardly satisfy the above requirements which clearly identifies the need for further developments in this area.

An object of this invention is to provide an improved voltage reference source.

SUMMARY OF THE INVENTION

According to a first aspect of the invention there is provided a method of forming an output voltage, comprising the steps of:

forming a first voltage $V_1$ which is proportional to a base-emitter voltage $V_{be}$ of a transistor ($V_1=m_1V_{be}$), wherein $m_1$ is a first weight coefficient;

forming a second voltage $V_2$ which is proportional to a thermal voltage $V_T$ of a transistor ($V_2=m_2 \cdot V_T$) wherein $m_2$ is a second weight coefficient;

adding first and second voltages to form the output voltage $V_{out}$.

The method further comprises the step of selecting the weight coefficients so as to provide the output voltage having a predetermined magnitude and predetermined function of the temperature. Conveniently, the method comprises the step of selecting the weight coefficients so as to control magnitude and temperature dependence of the output voltage independently. The weight coefficients may be selected so as to provide the output voltage which is independent of the temperature, or alternatively, to provide the output voltage which is an increasing or decreasing function of the temperature. Advantageously, it may be arranged that the increasing or decreasing function of the temperature are linear functions.

To form the first voltage as a fraction of the base-emitter voltage of a transistor, it can be selected that the first weight coefficient is less than unity, i.e. $m_1<1$. For many practical applications it may be selected that the output voltage is proportional to a bandgap voltage, e.g. equal to a fraction of the bandgap voltage, the bandgap voltage being typically 1.244V.

According to a second aspect of the invention, there is provided a method of forming a reference voltage, comprising the steps of:

forming the output voltage $V_{out}$ as defined above according to the first aspect of the invention; and adding a base-emitter voltage of a transistor $V_{be}$ to the output voltage $V_{out}$, thus forming the reference voltage $V_r=V_{out}+V_{be}$.

Conveniently, it may be arranged that the step of forming the output voltage is performed so as to provide that the output voltage is equal to a fraction of the bandgap voltage.

According to a third aspect of the invention, there is provided a voltage reference source, comprising:

means for forming a first voltage $V_1$ which is proportional to a base-emitter voltage $V_{be}$ of a transistor ($V_1=m_1 \cdot V_{be}$), wherein $m_1$ is a first weight coefficient;

means forming a second voltage $V_2$ which is proportional to a thermal voltage $V_T$ of a transistor ($V_2=m_2 \cdot V_T$), wherein $m_2$ is a second weight coefficient;

means for adding first and second voltages to form the output voltage $V_{out}$.

Preferably, the weight coefficients are selected so as to provide the output voltage having a predetermined magnitude and predetermined function of the temperature. Conveniently, it may be arranged that the weight coefficients are selected so that the magnitude and temperature dependence of the output voltage can be controlled independently, e.g. the magnitude of the output voltage is determined by absolute magnitudes of the weight coefficients, and the temperature dependence of the source is controlled by relative magnitudes of the weight coefficients. Depending on circuit requirements, it can be provided that the output voltage is independent of the temperature or has an increasing or decreasing function of temperature, the function being preferably linear functions.

To form the first voltage as a fraction of the base-emitter voltage of a transistor, the first weight coefficient should be less than unity, i.e. $m_1<1$. For many practical applications it may be arranged that the output voltage is proportional to a. bandgap voltage, e.g. equal to a fraction of the bandgap voltage.

Advantageously, the voltage reference source includes three transistors only which are coupled in parallel and balanced with a number of resistors. It allows for a low voltage supply of the circuitry because the lower limit of the voltage supply is defined by only one base-emitter voltage which is typically below 1V.

According to a fourth aspect of the invention there is provided a reference voltage source, comprising:

means for forming the output voltage $V_{out}$ as defined in accordance with the third aspect of the invention described above; and means for adding a base-emitter voltage of a transistor $V_{be}$ to the output voltage $V_{out}$ to form the reference voltage $V_r=V_{out}+V_{be}$.

According to a fifth aspect of the invention there is provided a voltage reference source, comprising:

first, second and third transistors and first to fifth resistors;

collector and base of the first transistor being connected to the base of the second transistor and to a through the first resistor to an output terminal;

collector of the second transistor being connected to the base of the third transistor and through the second resistor to the output terminal;

emitters of the first and third transistors being connected to a negative voltage terminal directly with the emitter of the third transistor being connected to the negative voltage terminal through the third resistor;

collector of the third transistor being connected to the output voltage terminal; and fourth and fifth resistors being connected across base-emitter junctions of the third and first transistors respectively.

Additionally, the output terminal is connected to a positive voltage terminal through a resistance means or through a current source.

Advantageously, the reference voltage source is operable at a low voltage supply, wherein the low voltage supply is of the order of 1.5V and lower. The voltage reference source circuit includes three transistors only connected in parallel and a number of resistors.

BRIEF DESCRIPTION OF THE DRAWINGS

Embodiments of the invention will now be described, by way of example, with reference to the accompanying drawings in which.

DESCRIPTION OF THE PREFERRED EMBODIMENT

Figure 1:
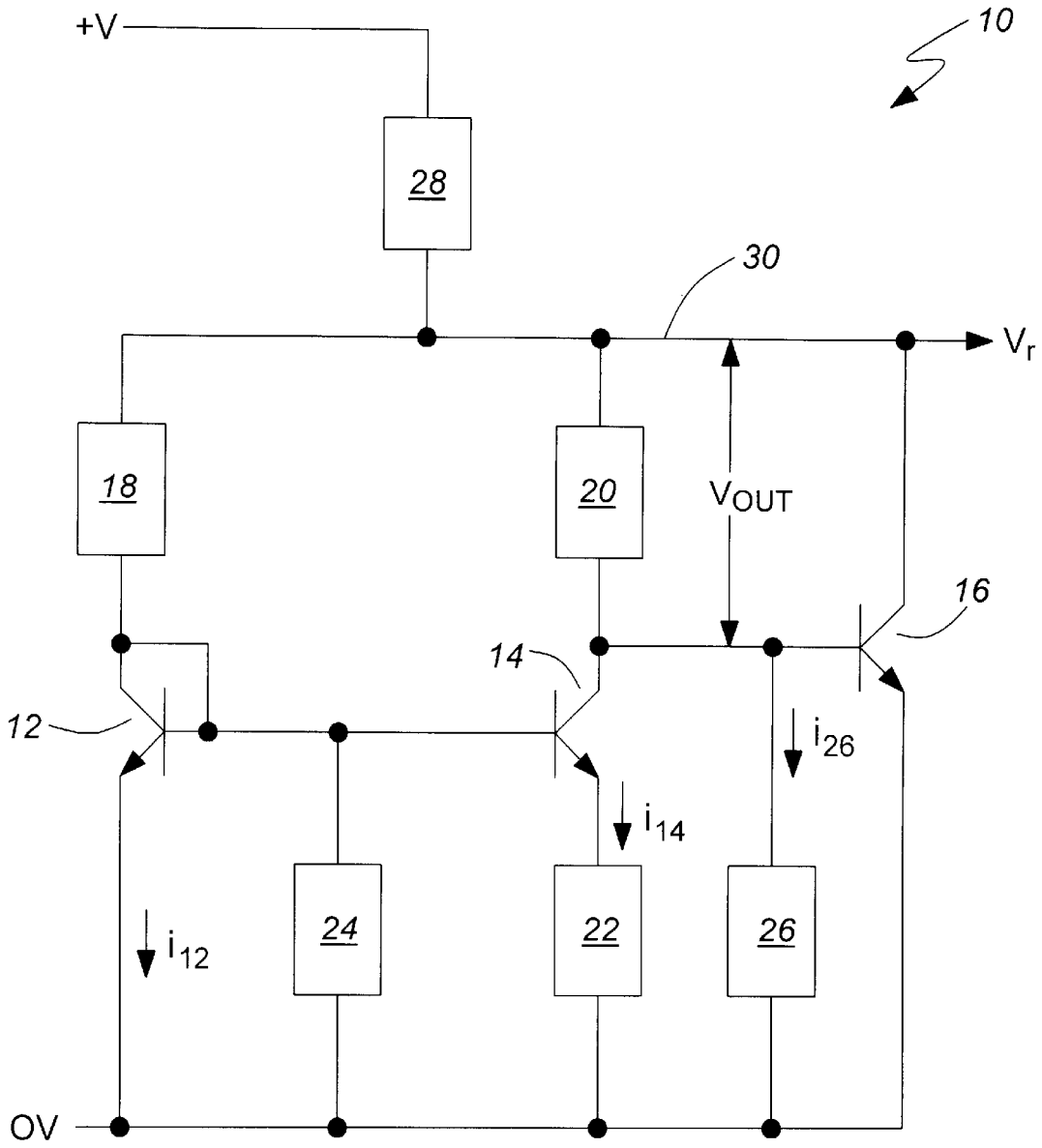
FIG. 1 illustrates a voltage reference circuit according to an embodiment of the invention.

FIG. 1 illustrates a voltage reference source 10 according to the embodiment of the invention. It comprises first, second and third NPN transistors 12, 14, 16, and six resistors 18, 20, 22, 24, 26 and 28. The resistors are referred to as in the following manner: the resistor 18 is referred to as a first resistor, 20 as a second resistor, 22 as a third resistor, 24 as a fourth resistor, 26 as a fifth resistor, and 28 as a sixth resistor. The transistor 12 has its emitter connected to negative voltage terminal or ground (0V), and its collector connected to its base and via resistor 18 to an output terminal designated by line 30 on which the circuit produces a reference voltage $V_r$. The transistor 14 has its emitter connected via the resistor 22 to ground (0V), its base connected to the base of the transistor 12. The transistor 14 is being sized relative to the transistor 12 to provide a current density through the transistor 14 which is lower than through the transistor 12, the ratio of current densities being for example of about 8. The collector of the transistor 14 is connected via the resistor 20 to the line 30. The transistor 16 has its base connected to the collector of the transistor 14, its emitter connected to ground (0V), and its collector connected to line 30. Resistors 24 and 26 are connected across base-emitter junctions of transistors 12 and 16 respectively, and the resistor 28 is connected between line 30 and a positive voltage terminal +V. The reference voltage $V_r$ and voltage produced on the resistor 20 referred to as an output voltage have predetermined temperature characteristics and provide independent control of the voltage magnitude as will be described in detail below.

The circuit 10 operates in the following manner. According to the Ohm's law, current $i_{26}$ through the resistor 26 may be expressed as follows:

$$I_{26}=V_{be16}/R_{26} \tag{1}$$

wherein $R_{26}$ is a magnitude of the resistor 26 and $V_{be16}$ is a base-emitter voltage of the transistor 16. Accordingly, a first voltage $V_1$ defined as a voltage drop on the resistor 20 produced by the current $i_{26}$ is equal to:

$$V_1=i_{26}R_{20}=(R_{20}/R_{26})V_{be16}=m_1V_{be16} \tag{2}$$

wherein $R_{20}$ is a magnitude of the resistor 20, and $m_1$ is a first weight coefficient.

Derivations of a second voltage $V_2$, defined as a voltage drop on the resistor 20 produced by current $i_{14}$, which flows through the transistor 14 and resistor 22, can be performed in the following manner.

It is known that a collector current of a bipolar transistor may be expressed as follows (see, e.g. a textbook "Microelectronics Circuits" by Adel S. Sedra and Kenneth C. Smith, Oxford University Press, 1991)

$$i=i_{ss}A\ \exp(V_{be}/V_T) \tag{3}$$

wherein $i_{ss}$ is a constant called a saturation current, $V_T$ is a thermal voltage, A is an emitter area, and $V_{be}$ is a voltage between the base and emitter.

Accordingly, applying equation (3) to transistors 12 and 14, we obtain expressions for corresponding collector currents of the transistors:

$$i_{12}=i_{ss}A_{12}\ \exp(V_{be12}/V_T) \tag{4}$$

$$i_{14}=i_{ss}A_{14}\ \exp(V_{be14}/V_T) \tag{5}$$

wherein $A_{12}$ and $A_{14}$ are areas of transistors 12 and 14 respectively, and $V_{be12}$ and $V_{be14}$ are corresponding voltages between their bases and emitters.

Dividing equations (4) and (5), we may find the ratio of currents flowing through transistors 12 and 14

$$\frac{i_{12}}{i_{14}}=\frac{A_{12}}{A_{14}}\exp\left(\frac{V_{be12}-V_{be14}}{V_T}\right) \tag{6}$$

and the difference between their base-emitter voltages $$V_{be12}-V_{be14}=V_T\ln\left(\frac{i_{12}}{i_{14}}\frac{A_{14}}{A_{12}}\right) \tag{7}$$

The expression of equation (7) equals to a voltage on the resistor 22, i.e. $V_{22}=V_{be12}-V_{be14}$.

Accordingly, current flowing through the resistor 22 and transistor 14 may be found as $$i_{14}=\frac{V_T\ln\left(\frac{i_{12}}{i_{14}}\frac{A_{14}}{A_{12}}\right)}{R_{22}} \tag{8}$$

Now it is easy to find the second voltage $V_2$ which is produced by current $i_{14}$ on the resistor $R_{20}$:

$$V_2=i_{14}R_{20}=\left[\frac{R_{20}}{R_{22}}\ln\left(\frac{i_{12}}{i_{14}}\frac{A_{14}}{A_{12}}\right)\right]V_T=m_2V_T \tag{9}$$

wherein $$m_2=\frac{R_{20}}{R_{22}}\ln\left(\frac{i_{12}}{i_{14}}\frac{A_{14}}{A_{12}}\right)$$

Accordingly, the output voltage $V_{out}$ equal to the voltage drop on resistor 20 has two components $V_1$ and $V_2$ and may be expressed as $$V_{out}=V_{20}=V_1+V_2=m_1V_{be16}+m_2V_T \tag{10}$$

It is known that base-emitter voltage of a transistor decreases with the temperature, while thermal voltage has an increasing dependence with the temperature. As follows from equation (10), by proper selection of weight coefficients $m_1$ and $m_2$ it is possible to control temperature dependence of the output voltage and its magnitude. Conveniently, it may be arranged that the output voltage is equal to a fraction of a bandgap voltage, i.e. $V_{out}=kV_{bg}$, wherein k is a scaling coefficient and $V_{bg}$ is bandgap voltage.

Resistor 24 is required to control the current flowing through the resistor 18 and to provide balance of currents in the circuit 10. It is required that voltages on resistors 18 and 20 be equal, which means that resistors 24, 26, 18 and 20 would satisfy the following proportion $R_{20}/R_{18}=R_{26}/R_{24}$. For example, it can be arranged that $R_{20}=R_{18}$ and $R_{26}=R_{24}$.

The reference voltage $V_r$ is formed by adding another base-emitter voltage $V_{be16}$ to the output voltage $V_{out}$, thus providing the required biasing voltage that is widely used in microelectronics applications:

$$V_r = V_{out} + V_{be16} \tag{11}$$

Similar to the above discussion with regard to the output voltage, the magnitude and temperature dependence of the output voltage can be controlled independently by proper selection of absolute and relative value's of weight coefficients. Conveniently it may be arranged that $V_r = kV_{bg} + V_{be16}$, i.e. the reference voltage is a fraction of the bandgap voltage plus one base-emitter voltage, the voltage which is required for biasing purposes.

In modifications to the embodiment of the voltage reference source described above, the circuit may comprise different types of transistors, e.g. MOSFET, FET heterojunction or any other known transistors. The first to fifth resistors may comprise a combination of resistors, or alternatively any other semiconductor devices having resistance. The sixth resistor 28 may be replaced with any known resistance means or a current source.

Advantages of the embodiment of the present invention are as follows. The circuit described above has simple design, occupies less area compared to other known reference voltage circuits and correspondingly dissipates less heat and consumes less power. Due to the use of a minimal number of transistors, which are connected in parallel, the circuit is operable at much lower voltage supply than other known circuits, e.g. of the order of 1.5V or lower. Additionally, it provides an independent control of the magnitude of the reference voltage and its temperature dependence.

Thus, it will be appreciated that, while specific embodiments of the invention are described in detail above, numerous variations, combinations and modifications of these embodiments fall within the scope of the invention as defined in the following claims.

What is claimed is:

1. A method of forming an output voltage, comprising the steps of:

forming a first voltage $V_1$ which is proportional to a base-emitter voltage $V_{be}$ of a transistor ($V_1 = m_1 \cdot V_{be}$), wherein $m_1$ is a first weight coefficient;

forming a second voltage $V_2$ which is proportional to a thermal voltage $V_T$ of a transistor ($V_2 = m_2 \cdot V_T$), wherein $m_2$ is a second weight coefficient;

adding first and second voltages to form the output voltage $V_{out}$.

2. A method as defined in claim 1, comprising the step of selecting the weight coefficients so as to provide the output voltage having a predetermined magnitude and predetermined function of the temperature.

3. A method as defined in claim 1, comprising the step of selecting the weight coefficients so as to control magnitude and temperature dependence of the output voltage independently.

4. A method as defined in claim 2, comprising the step of selecting the weight coefficients so as to provide that the output voltage is independent of the temperature.

5. A method as defined in claim 2, comprising the step of selecting the weight coefficients so as to provide that the output voltage is an increasing function of the temperature.

6. A method as defined in claim 2, comprising the step of selecting the weight coefficients so as to provide that the output voltage is a decreasing function of the temperature.

7. A method as defined in claim 5, wherein the step of selecting the weight coefficients comprises selecting the coefficients so that the increasing function of the temperature is a linear function.

8. A method as defined in claim 6, wherein the step of selecting the weight coefficients comprises selecting the coefficients so that the decreasing function of the temperature is a linear function.

9. A method as defined in claim 1, comprising the step of selecting $m_1 < 1$.

10. A method as defined in claim 1, comprising the step of selecting the weight coefficients so as to provide that the output voltage is proportional to a bandgap voltage.

11. A method as defined in claim 10, wherein the step of selecting the weight coefficients comprises selecting the coefficients so that the output voltage is a fraction of the bandgap voltage.

12. A method of forming a reference voltage, comprising the steps of:

forming the output voltage $V_{out}$ as defined in claim 1; and adding a base-emitter voltage of a transistor $V_{be}$ to the output voltage $V_{out}$, thus forming the reference voltage $V_r = V_{out} + V_{be}$.

13. A method as defined in claim 11, wherein the step of forming the output voltage is performed in accordance with claim 11.

14. A voltage reference source, comprising means for forming a first voltage $V_1$ which is proportional to a base-emitter voltage $V_{be}$ of a transistor ($V_1 = m_1 \cdot V_{be}$), wherein $m_1$ is a first weight coefficient;

means forming a second voltage $V_2$ which is proportional to a thermal voltage $V_T$ of a transistor ($V_2 = m_2 \cdot V_T$), wherein $m_2$ is a second weight coefficient;

means for adding first and second voltages to form the output voltage $V_{out}$.

15. A source as defined in claim 14, wherein the weight coefficients are selected so as to provide the output voltage having a predetermined magnitude and predetermined function of the temperature.

16. A source as defined in claim 14, wherein the weight coefficients are selected so as to control magnitude and temperature dependence of the output voltage independently.

17. A source as defined in claim 15, wherein the magnitude of the output voltage is determined by absolute magnitudes of the weight coefficients.

18. A source as defined in claim 15, wherein the temperature dependence is controlled by relative magnitudes of the weight coefficients.

19. A source as defined in claim 15, wherein the weight coefficients are selected so as to provide that the output voltage is independent of the temperature.

20. A source as defined in claim 15, wherein the weight coefficients are selected so as to provide that the output voltage is an increasing function of the temperature.

21. A source as defined in claim 15, wherein the weight coefficients are selected so as to provide that the output voltage is a decreasing function of the temperature.

22. A source as defined in claim 20, wherein the weight coefficients are selected so that the increasing function of the temperature is a linear function.

23. A source as defined in claim 16, wherein the weight coefficients are selected so that the decreasing function of the temperature is a linear function.

24. A source as defined in claim 14, wherein $m_1 < 1$.

25. A source as defined in claim 1, wherein the weight coefficients are selected so as to provide that the output voltage is proportional to a bandgap voltage.

26. A source as defined in claim 25, wherein the weight coefficients are selected so that the output voltage is a fraction of the bandgap voltage.

27. A source as defined in claim 14, comprising three transistors only.

28. A source as defined in claim 27, consisting of three transistors connected in parallel which are balanced with a number of resistors.

29. A source as defined in claim 28, wherein the total number of resistors is six.

30. A reference voltage source, comprising:

means for forming the output voltage $V_{out}$ as defined in claim 1; and means for adding a base-emitter voltage of a transistor $V_{be}$ to the output voltage $V_{out}$ to form the reference voltage $V_r=V_{out}+V_{be}$.

31. A reference voltage source as defined in claim 30, operable at a low voltage supply.

32. A reference voltage source as defined in claim 31, wherein the low voltage supply is of the order of 1.5V and lower.

33. A reference voltage source as defined in claim 30, comprising three transistors only connected in parallel which are balanced with a number of resistors.

34. A voltage reference source, comprising:

first, second and third transistors and first to fifth resistors;

collector and base of the first transistor being connected to the base of the second transistor and to a through the first resistor to an output terminal;

collector of the second transistor being connected to the base of the third transistor and through the second resistor to the output terminal;

emitters of the first and third transistors being connected to a negative voltage terminal directly with the emitter of the third transistor being connected to the negative voltage terminal through the third resistor;

collector of the third transistor being connected to the output voltage terminal; and fourth and fifth resistors being connected across base-emitter junctions of the third and first transistors respectively.

35. A voltage reference source as defined in claim 34, wherein the output terminal is connected to a positive voltage terminal through a resistance means.

36. A voltage reference source as defined in claim 34, wherein the output terminal connected to a positive voltage terminal through a current source.

* * * * *